United States Patent [19]

Pellerin et al.

[11] 4,298,850

[45] Nov. 3, 1981

[54] DOUBLE RIDGE WAVEGUIDE ROTARY JOINT

[75] Inventors: Andrew P. Pellerin, Salem, N.H.; Christ Theophile, Bedford, Mass.

[73] Assignee: Microwave Antenna Systems and Technology Inc., Burlington, Mass.

[21] Appl. No.: 142,040

[22] Filed: Apr. 21, 1980

[51] Int. Cl.[3] ..... H01P 1/06

[52] U.S. Cl. ..... 333/257; 333/26; 333/34

[58] Field of Search ..... 333/26, 34, 35, 256, 333/257, 261

[56] References Cited

U.S. PATENT DOCUMENTS

| | | | |
|---|---|---|---|
| 2,627,551 | 2/1953 | Taylor et al. | 333/261 X |
| 2,982,927 | 5/1961 | Grimm et al. | 333/34 |
| 3,023,382 | 2/1962 | Borghetti | 333/34 |
| 3,188,583 | 6/1965 | Boyd | 333/35 X |
| 3,599,127 | 8/1971 | Krijger | 333/256 |

*Primary Examiner*—Paul L. Gensler
*Attorney, Agent, or Firm*—Robert T. Dunn

[57] ABSTRACT

An I type (straight) double ridge waveguide rotary joint is provided by connecting input and output sections of double ridge waveguide, oriented along a common axis, to opposite ends of a coaxial line rotary joint that is on the same axis. The input and output sections each connect to the coaxial line rotary joint by a transformer that connects one ridge to the center conductor of the adjacent coaxial line and the other ridge to the outer conductor of the coaxial line, the connections being made in several transitions to avoid an abrupt change of impedance in progressing along the axis through the transformer. In a preferred embodiment, the coaxial line rotary joint and the input and output double ridge waveguides all have air as the dielectric in the path of the high frequency waves and in that case, the transformer includes one section that begins as double ridge waveguide and progressively (in steps) changes to single ridge waveguide and meets an expanded coaxial line section that progressively (also in steps) changes to the coaxial line of the rotary joint; and so these transformer sections provide a gradual change of impedance along the axis between the double ridge waveguide and the coaxial line of the rotary joint and visa versa.

9 Claims, 13 Drawing Figures

DOUBLE RIDGE WAVEGUIDE ROTARY JOINT

BACKGROUND OF THE INVENTION

This invention relates to rotary joints for conducting high frequency electrical energy from one transmission line to another while allowing one to rotate with respect to the other.

A widely used rotary joint structure for conducting high frequency electric waves from one transmission line to another is most often a coaxial transmission line in two sections that match each other mechanically and electrically where they meet so that one section can rotate on their common axis with respect to the other one. The mechanical and electrical matching is readily accomplished using the coaxial type transmission line, because the line is essentially a figure of revolution and since one section must revolve on the common axis with respect to the other section, there is no change in the mechanical or electrical matching as one section revolves with respect to the other. For these reasons, it has been the practice to make the mating rotating parts of a transmission line rotary joint in the form of a coaxial line even though the input and output transmission lines may be waveguide or other types of transmission line. It then becomes necessary to match the input and output transmission lines to that coaxial line section to insure proper performance as measured by insertion loss and standing wave voltage ratio (VSWR) in the system. Heretofore, this matching from a waveguide section to the rotary coaxial line section has been done at an L turn, and so the axis of the waveguide is not common with the axis of the coaxial line rotary joint. It is one object of the present invention to provide a rotary joint for input and output waveguides on a common axis with the coaxial rotary line so that a straight transmission line is defined by the input waveguide, the coaxial line rotary joint, and the output waveguide.

In a rotary joint transmission line where, as usual, the abutting rotary parts define a coaxial transmission line and other types of transmission lines such as waveguides connect as the input and output to opposite ends of the rotary coaxial line, it is often preferred that the dielectric between the conductors of all these transmission lines be air. There are many reasons for this, one being that air does not degrade or change with time and it is intimately contiguous with all the conductors. Also, where a solid dielectric interfaces with another or interfaces with air, undesired reflections can occur. However, with air as the dielectric, matching a waveguide to a coaxial line is commonly done at an L section transformer so that the input and output waveguides are not coaxial with each other or with the rotary joint. This is particularly the case where the waveguide is ridged. Accordingly, it another object of the present invention to provide a rotary joint for connecting input and output waveguides on a common axis with the rotary coaxial section, wherein the dielectric throughout is air.

SUMMARY OF THE INVENTION

In accordance with generic features of the present invention, an I type or straight double ridge waveguide rotary joint is provided in which input and output sections of double ridge waveguide on a common axis connect to opposite sides of a coaxial line rotary joint on the same axis, each via a transformer that connects one ridge of the waveguide to the center conductor of the adjacent coaxial line and connects the other ridge of the waveguide to the outer conductor of the coaxial line, while the rest of the inside conductor of the waveguide is shaped gradually through the transformer to meet the outer conductor of the coaxial line. In a preferred embodiment of the present invention, particularly where the dielectric throughout the waveguides and coaxial rotary joint is air, the transformer includes one section that meets both ridges of the waveguide, connecting one ridge to the center conductor of the coaxial line and the other to the outer conductor of the coaxial line and gradually transitions from the double ridge waveguide cross section shape to a single ridge waveguide cross section shape, from where it gradually transitions from the single ridge waveguide cross section shape to the coaxial line, the transitions being accomplished by either smooth sloping conductive surfaces or by a series of steps.

In addition to the objects of the present invention already mentioned, it is another object to provide an improved waveguide to waveguide rotary joint transmission line.

It is another object to provide an improved ridged waveguide to ridged waveguide rotary joint transmission line.

It is a still further object in conjunction with either of the above two objects to provide such a rotary joint transmission line wherein the input and output waveguides and the rotary portion are all on a common axis and the dielectric throughout all transmission line paths is air.

These and other features and objects of the present invention will be apparent in view of the description of an embodiment that follows, taken in conjunction with the drawings that represent the best known use of the invention.

DESCRIPTION OF THE EMBODIMENTS OF THE INVENTION

Figure 1:
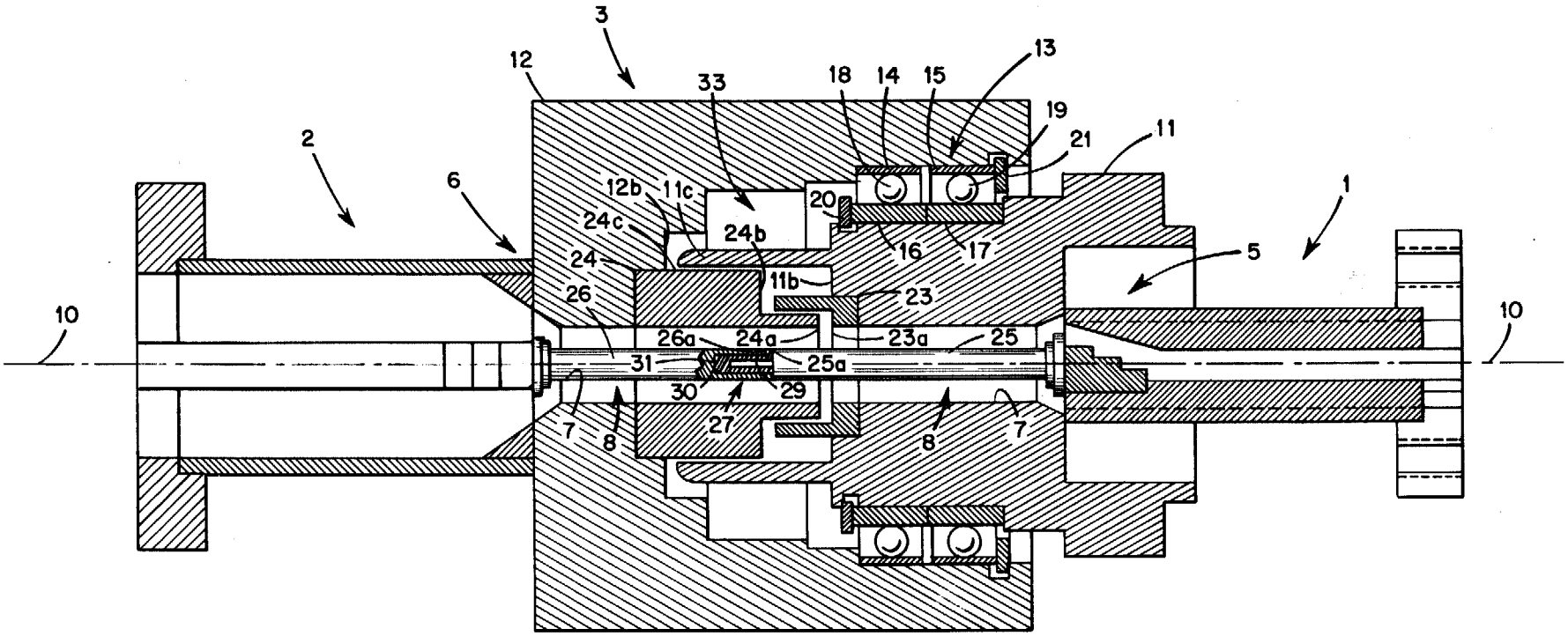
FIG. 1 is a longitudinal cross section view showing input and output double ridge waveguides each connected by a transformer section to opposite ends of the coaxial line rotary joint so that both waveguides and the coaxial line rotary joint are on a common axis and the dielectric throughout is air.

Turning first to FIG. 1, there is shown in longitudinal cross section a double ridge waveguide to double ridge waveguide rotary joint including input and output double ridge waveguides 1 and 2 that connect to opposite ends of coaxial line rotary joint 3. Input 1 connects by a transformer section 5 formed in part at the end of the waveguide and in part at the abutting end of the coaxial line. Similarly, for output waveguide 2 a transformer section 6 is provided, also, formed in part at the end of the waveguide and in part at the abutting end of the coaxial line. The axes of the input and output waveguides and the coaxial line rotary joint are all common and represented by axis line 10.

The coaxial line rotary joint 3 is formed in two housings 11 and 12 that are connected together and one is supported by the other by bearings 13. These bearings include two outer races 14 and 15 attached to housing 12 and two inner races 16 and 17 attached to housing 11. Ball bearings such as 18 and 19 captured between these races connect the two housings so that they can rotate on the axis 10 independent of each other. The races and balls are contained in place by retainer rings 20 and 21.

The housings 11 and 12 are bored along the axis 10 to define a portion in each of the outer conductor 7 of the coaxial line of the rotary joint. They are also machined to accomodate inserts defining other portions of the outer conductor of the coaxial line. More particularly housing 11 is machined to accept and hold rigidly insert piece 23 and housing 12 is machined to accept and hold rigidly piece 24. These pieces 23 and 24 define further portions of the outer conductor of coaxial line and a portion of 23 overlaps a portion of 24 where the outer conductor of the coaxial line in one section meets the other and forms a choke that produces, in effect, an electrical short circuit to high frequency energy between the two points 23*a* and 24*a*. In this way, the outer conductor of the coaxial line in the rotary joint performs electrically as a continuous conductor although the two sections of it can mechanically rotate independently on the axis 10.

The center conductor 8 of the coaxial line rotary joint is also in two sections, section 25 and section 26. Section 25 fastens fixedly to the abutting end of the input ridge waveguide 1, while section 26 fastens rigidly to the abutting end of output waveguide 2. These two sections meet at 27 where they interleave. The interleave includes a single finger 29 along axis 10 extending from the end of section 25 and an accommodating bore 30 in section 26 and the space between these is filled with a suitable solid dielectric 31. The spacing between the finger 29 and the bore 30 is such that an electrical short circuit is produced to high frequency electric waves substantially across these sections 25 and 26 between the two points 25*a* and 26*a*.

A virtual short circuit to high frequency electric waves is produced at the opening to a path that terminates an electrical distance equal to one quarter wavelength of the frequency of the electric waves from the opening. The opening across points 23*a* and 24*a* leads to a narrow inner gap between the two inserts 23 and 24 that is substantially a quarter wavelength long from the opening to surface 24*b* and another quarter wavelength from surface 24*b* to surface 11*b*. These surfaces, 24*b* and 11*b*, are the ends of an electrical cavity that is clearly fixed in dimension and the parts that form the cavity can rotate independently about the axis 10. Some high frequency energy can leak from this cavity through the very narrow opening between the projecting cylindrical section 11*c* of the housing 11 and surface 24*c* of the insert 24. The length of that narrow opening from the cavity to wall 12*b* of housing 12 is, again, about one quarter wavelength. Thus, the cavity defined by surfaces 24*b* and 11*b* is annular in shape. It insures a virtual short to the high frequency energy across the points 23*a* and 24*a* and very little energy escapes from it into the bearing space 33. In a similar way, a short circuit is produced across the two center conductor sections of the coaxial line, sections 25 and 26. Here, the space between the finger 29 and the bore 30 defines a reentrant cavity. The dimensions of this cavity and the dielectric 31 that fills it are such that an electrical short circuit is produced across points 25*a* and 26*a* at the frequency of the electric waves conducted by the coaxial line.

Figure 2:
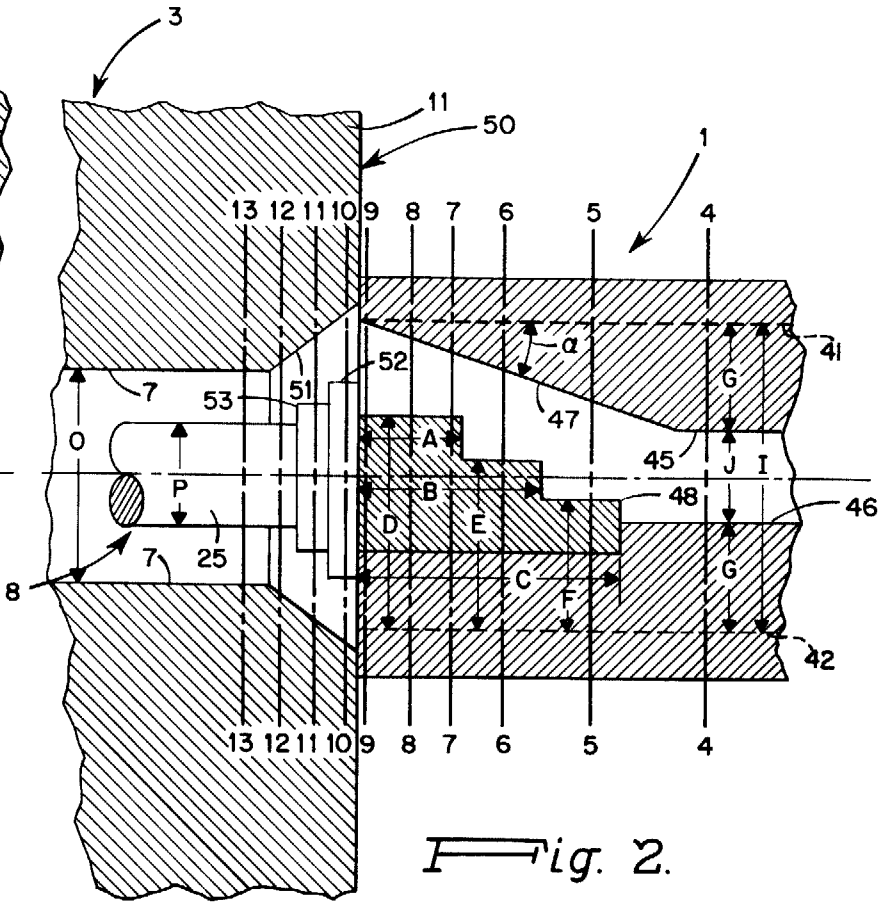
FIG. 2 shows an enlargement of a portion of FIG. 1, the enlargement being a view of the transformer between one of the ridge waveguides and the coaxial line.
Figure 3:
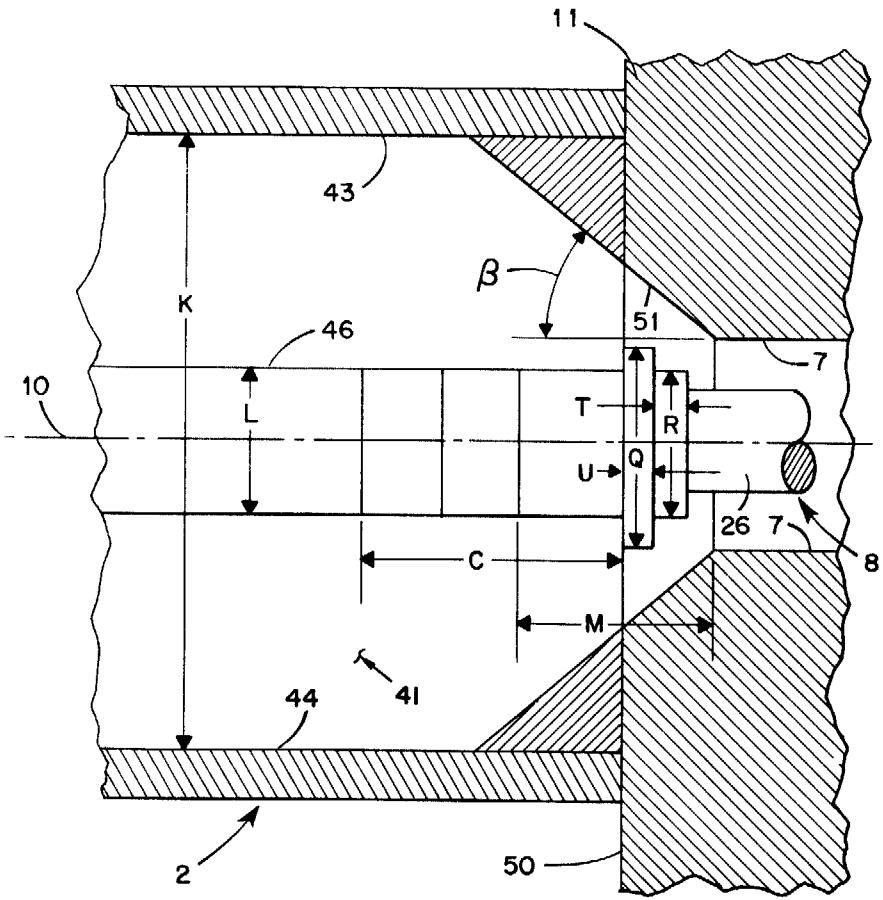
FIG. 3 is an enlarged view of the section of FIG. 1 at the other transformer section showing the other transverse view of the transformer.
Figure 4:
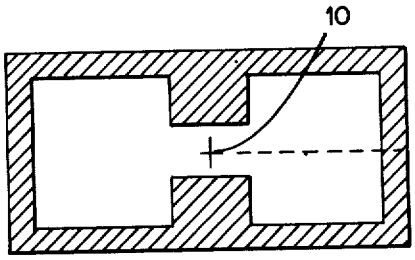
FIGS. 4 to 13 show the cross section profile of the transformer section at steps beginning in the double ridge waveguide and ending in the coaxial line of the rotary joint showing the progressive transitions from double ridge waveguide to coaxial line and vise versa.
Figure 5:
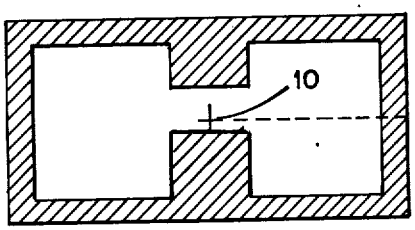
Figure 6:
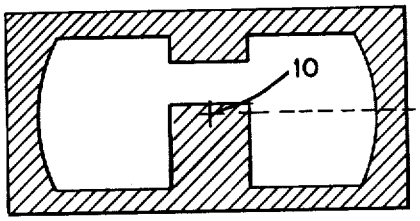
Figure 7:
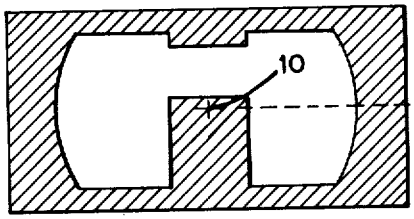

The input and output double ridge wavelengths 1 and 2 are shown in FIG. 1 oriented with the major dimensions transverse. More particularly, the major dimension of the input waveguide 1 is into the page and the major dimension of the output waveguide 2 is parallel to the page. Clearly, the input and output waveguides are fixedly attached to the coaxial line rotary joint where they abut the rotary joint. Input 1 is fixedly attached to housing 11 and rotates with that housing while output 2 is fixedly attached to housing 12 and rotates with that housing. Thus, the two ends of the complete assembly rotate independent of each other about the common axis 10. The transformer 5 where input 1 connects to housing 11 and the transformer 6 where output 2 connects to housing 12 are mechanically and electrically identical and are mirror images of each other about a plane perpendicular to the axis 10 when they are oriented the same. FIGS. 2 and 3 show enlarged views of the transformers 5 and 6, respectively, at the same orientations as in FIG. 1. Since these transformers are identical in construction, the two views, FIGS. 2 and 3, reveal all details of the transformer. Various dimensions of portions of the transformer are indicated by capital letters and tables of these dimensions expressed in wavelength $\lambda$ of the high frequency electric fields are defined hereinbelow. FIGS. 4 through 13 show the cross section profiles taken perpendicular to the axis 10 across transformer 5 at progressive positions along the axis from the double ridge waveguide to the coaxial line.

Figure 8:
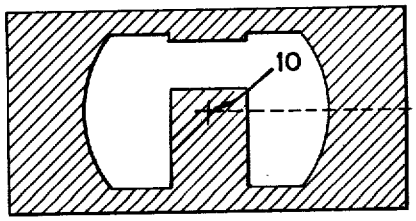
Figure 9:
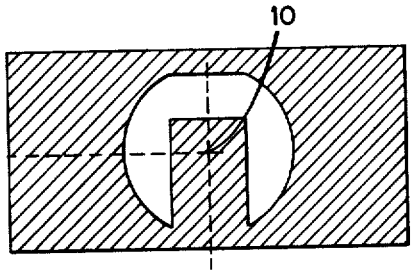

Since the input and output double ridge waveguides and their transformers to the coaxial line rotary joint may be constructed substantially identical, corresponding parts are referred to by the same reference number. With this in mind, turn next to FIGS. 2 and 3. These Figures. show details of construction and identify dimensions of the waveguides, the transformer sections and the coaxial line. The waveguide sections are each rectangular in cross section shape, having two major conductive walls 41 and 42 and two minor conductive walls 43 and 44 and two opposing ridges 45 and 46, ridge 45 projecting from wall 41 and ridge 46 projecting from wall 42. At the end of the waveguide connected to the coaxial line, the ridges are contoured; ridge 45 slopes gradually at 47 to the end of the waveguide defining a slope angle $\alpha$ and ridge 46 includes 3 steps that follow the slope at 47. The 3 steps are provided by an insert 48 that attaches to ridge 46. Hence, the cross section profile of the waveguide along this transition, taken as shown in FIG. 2, is illustrated by FIGS. 4 to 9. Clearly, these profiles show that the double ridge waveguide gradually changes to the single ridge waveguide shown by FIG. 9. The rectangular shaped profile becomes round at the end of the third step of the insert 48. From the rise of the third step, and along the third step, the four walls of the waveguide that define a rectangle begin to define a circle. This is shown by FIGS. 8 and 9, the last being the profile of the waveguide substantially at the interface 50 where the waveguide meets the coaxial line housing (housing 11 or 12). Thus, the cross section profile of the double waveguide progressively changes from FIG. 4 to FIG. 9 where it abuts the coaxial line at interface 50.

Figure 10:
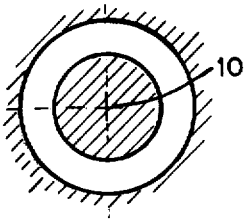
Figure 11:
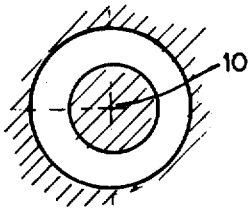
Figure 12:
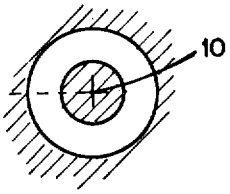
Figure 13:
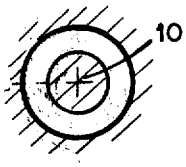

The profile of the coaxial line at the interface 50 is illustrated by FIG. 10. Clearly, the outer conductor in FIG. 10 is substantially the same size and shape as the waveguide walls have become in FIG. 9, and these are coincident at the interface 50. From the interface 50, the outer conductor of the coaxial line tapers at 51 at an angle $\beta$ to meet the coaxial line outer conductor 7. From the interface 50 the center conductor of the coaxial line decreases in diameter in two steps defined by cylindrical elements 52 and 53 at the end of the center conductor 8 of the coaxial line. These two steps follow the slope of 51 at angle $\beta$ and the profiles at sections 10 to 13 are represented by FIGS. 10 to 13, respectively.

DETAILS OF A SPECIFIC EMBODIMENT

As an example of a particular embodiment of the present invention, let the input and output waveguides conduct the high frequency f in the TE01 mode. The coaxial line will conduct f in the TEM mode. The cut-off frequency of the coaxial line, fc, is defined in terms of its wave length λc as follows:

$$\lambda c = \frac{\pi}{2}(O + P)$$

and the impedance of the coaxial line is given by:

$$Z = 138 \log (o/p)$$

If we select f as for example 12.75 GHz for which $\lambda = 0.926$ inches in air, then it would be desirable for $f_c$ to be about 25 GHz. Furthermore, if we would set the characteristic impedance of the coaxial line at about 60Ω, we could then calculate the diameter of the outer conductor and the diameter of the inner conductor of the coaxial line. These are dimensions O and P shown in the Figures. These and other dimensions also shown in the Figures expressed in terms of the wavelength $\lambda = 0.926$ inches are listed in the Table below.

TABLE I

| Dimension Designation | Dimension in terms of Wavelength λ |
|---|---|
| A | .353 λ |
| B | .226 |
| C | .114 |
| D | .256 |
| E | .211 |
| F | .156 |
| G | .100 |
| I | .347 |
| J | .147 |
| K | .854 |
| L | .187 |
| M | .294 |
| O | .237 |
| P | .086 |
| Q | .162 |
| R | .111 |
| T | .046 |
| U | .092 |

A ridge waveguide to ridge waveguide rotary joint constructed as presented in detail above can be expected to have an overall insertion loss of 0.075 dB and WVSR will not exceed 1.5:1.0.

CONCLUSIONS

The ridge waveguide, straight through rotary joint transmission line described herein represents the best known use of the present invention. The portion of the structure formed by the coaxial line rotary joint is considered generally to be in the prior art, although there are some features of this joint that yield some advantage over the prior art. The thrust of the present invention lies in the combination of such a coaxial line rotary joint with double ridge input and output waveguides all aligned on a common axis. This arrangement and alignment is made possible by the unique transformer structure that connects the double ridge waveguide to the coaxial line. The technique incorporated in the structure and performance of the transformer enables the "straight through" transmission line path through the input waveguide, the coaxial line rotary joint and the output waveguide. It also allows an air dielectric throughout the transmission line. Clearly, considerable variation of the parts of the structure could be made, particularly the coaxial line rotary joint, and some modifications could be made of the transformer sections without deviating from the spirit and scope of the invention as set forth in the appended claims.

What is claimed is:

1. A rotary joint transmission line for conducting high frequency electric waves from an input transmission line section to an output transmission line section so that one line section can be mechanically rotated with respect to the other while the high frequency waves are conducted from the input to the output transmission line section comprising, (a) one of said input and output sections is a ridge waveguide transmission line and both sections are oriented with their electrical axes on a common line, (b) a coaxial line rotary joint having two parts, an input part and an output part, that fit together mechanically to define a coaxial transmission line at least one part being rotatable on an axis of rotation with respect to the other part coincident with the common line (c) a transformer section of transmission line oriented with its electrical axis on said common line, rigidly connecting said ridge waveguide transmission line section to one of said parts of the rotary joint, (d) the cross section profile of the transformer section and the ridge waveguide section where they connect being the same and in registration, (e) the cross section profile of the transformer section and the one part of the rotary joint where they connect being the same and in registration, (f) another transformer section of transmission line connecting the other part of the rotary joint to the other transmission line section.

2. A rotary joint transmission line as in claim 1 wherein both the input and the output transmission line sections are ridge waveguides, both define axes and those axes are both coincident with said axis of rotation and so there is the common axis for the input and output transmission line sections, the coaxial line, the transformer sections and the axis of rotation of the rotary joint.

3. A rotary joint transmission line as in claim 2 wherein one of the ridge waveguide transmission line sections is a double ridge waveguide and the transformer section between the double ridge waveguide section and the part of the rotary joint to which it is connected includes, (a) a first transition from said double ridge waveguide form to essentially a single ridge waveguide form, (b) a second transition from said coaxial line form to another coaxial line form of which the outer conductor form is essentially in registration with the walls of the single ridge waveguide form of the first transition and (c) the center conductor of the second transition is opposed to the ridge of the single ridge waveguide form of the first transition and (d) the first and second transitions abut and are contiguous where they are in registration.

4. A rotary joint transmission line as in claim 3 wherein, (a) the first transition of the transformer section has several different cross section profiles from the double ridge waveguide end to the single ridge waveguide and thereof, said profiles being such that there is a gradual change of impedance from the double ridge waveguide end to the single ridge waveguide end thereof.

5. A rotary joint transmission line as in claim 4, wherein said profiles of the first transition progressively change from a generally rectangular double ridge waveguide profile to a circular single ridge waveguide profile.

6. A rotary joint transmission line as in claim 5 wherein the circular part of the single ridge profile of the first transition is in registration with and contiguous with the outer conductor periphery at the immediately adjacent end of the second transition.

7. A rotary joint transmission line as in claim 6 wherein said first and second transitions are on a common axis that is also common with said axis of rotation.

8. A rotary joint transmission line as in claim 3 wherein both of said input and output transmission line sections are double ridge waveguide and the transformer sections that connect said input and output lines to their respective parts of the rotary joint include similar transitions.

9. A rotary joint transmission line as in claim 8 wherein the cross section profile of said similar transitions are mirror images of each other with respect to a plane perpendicular to the common axis at least one rotary position of the rotary joint.

* * * * *